US011211747B2

(12) United States Patent
Wang et al.

(10) Patent No.: US 11,211,747 B2
(45) Date of Patent: Dec. 28, 2021

(54) CONNECTOR HAVING A PAIR OF SPRINGS AT TWO OPPOSITE SIDES OF A CONVEX SLIDE GROOVE FOR URGING AN UNLOCKING SLIDER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chien-Chiung Wang, New Taipei (TW); Kun-Lin Wu, New Taipei (TW); Xue-Liang Zhang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/918,589

(22) Filed: Jul. 1, 2020

(65) Prior Publication Data

US 2021/0006013 A1 Jan. 7, 2021

(30) Foreign Application Priority Data

Jul. 1, 2019 (CN) ..... 201910584337.4

(51) Int. Cl.
*H01R 13/62* (2006.01)
*H01R 13/629* (2006.01)
*H01R 13/633* (2006.01)

(52) U.S. Cl.
CPC ... *H01R 13/62961* (2013.01); *H01R 13/6335* (2013.01)

(58) Field of Classification Search
CPC ..... H01R 13/6335
See application file for complete search history.

(56) References Cited

FOREIGN PATENT DOCUMENTS

CN 109212693 1/2019

*Primary Examiner* — Ross N Gushi
(74) *Attorney, Agent, or Firm* — Ming Chieh Chang; Wei Te Chung

(57) ABSTRACT

A connector to be mated with a mating connector through a lock, includes: a connector body including an mounting portion having a receiving space and a slide groove provided on the mounting portion; and an unlocking mechanism held on the connector body, the unlocking mechanism including an unlocking slider slidable along the slide groove and an elastic member for driving the unlocking slider to slide; wherein the slide groove has a convex surface protruding outward, the unlocking slider has a concave surface cooperating with the convex surface of the slide groove, the concave surface makes a wall thickness of the unlocking slider uneven, and the elastic member is located at an area of the unlocking slider having a thicker wall thickness.

15 Claims, 9 Drawing Sheets

CONNECTOR HAVING A PAIR OF SPRINGS AT TWO OPPOSITE SIDES OF A CONVEX SLIDE GROOVE FOR URGING AN UNLOCKING SLIDER

BACKGROUND OF THE INVENTION

1. Field of the Invention

The present invention relates generally to a connector, and more particularly to a connector which can be locked with a mating connector.

2. Description of Related Arts

China patent No. CN109212693A discloses a connector which can be locked with a mating connector. The connector comprising a connector body and an unlocking mechanism installed on the connector body. The connector body is provided with an installation portion having a receiving space, and a slide groove is provided on the installation portion. The unlocking mechanism includes an unlocking slider that can slide along the slide groove and an elastic member that can drive the sliding of the unlocking slider. Since the unlocking slider and the elastic member occupy the upper part of the space of the connector body, the receiving space on the connector body becomes smaller and large-diameter cables or other components cannot be accommodated in the receiving space.

An improved connector is desired.

SUMMARY OF THE INVENTION

A main object of the present invention is to provide a connector with an unlocking mechanism, which can accommodate a cable with a larger diameter.

To achieve the above-mentioned object, a connector to be mated with a mating connector through a lock includes: a connector body including an mounting portion having a receiving space and a slide groove provided on the mounting portion; and an unlocking mechanism held on the connector body, the unlocking mechanism including an unlocking slider slidable along the slide groove and an elastic member for driving the unlocking slider to slide; wherein the slide groove has a convex surface protruding outward, the unlocking slider has a concave surface cooperating with the convex surface of the slide groove, the concave surface makes a wall thickness of the unlocking slider uneven, and the elastic member is located at an area of the unlocking slider having a thicker wall thickness.

Compared to the prior art, the present invention has the advantage that the convex surface on the slide groove and the concave surface on the unlocking slider cooperate with each other, and the elastic member is placed in the thicker area of the wall of the unlocking slider. This makes the size of the receiving space larger when the volume of the connector is unchanged, so as to accommodate cables or other components with a larger diameter in the receiving space.

DETAILED DESCRIPTION OF THE PREFERRED EMBODIMENT

Figure 1:
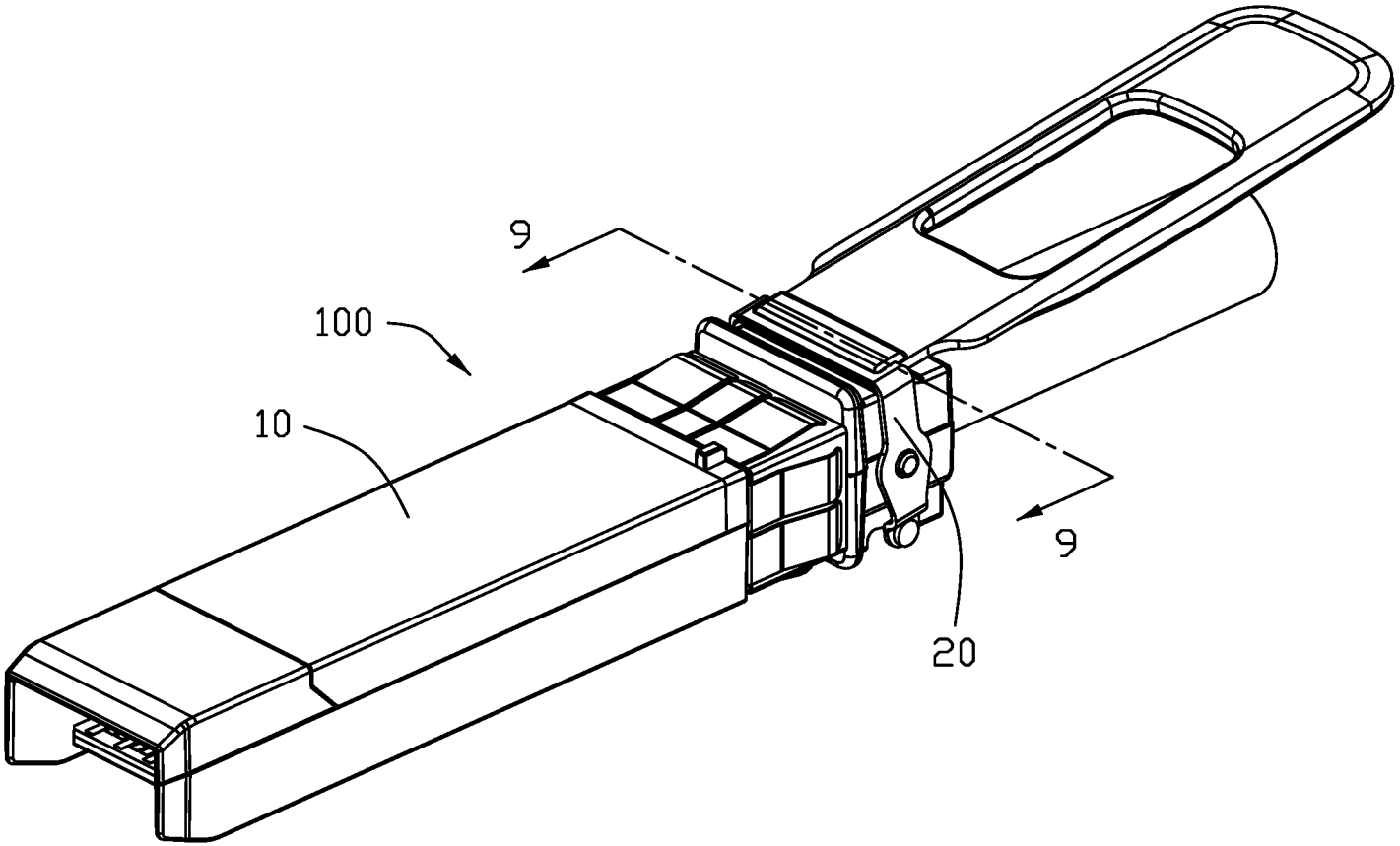
FIG. 1 is a perspective view of a connector in accordance with the present invention.
Figure 2:
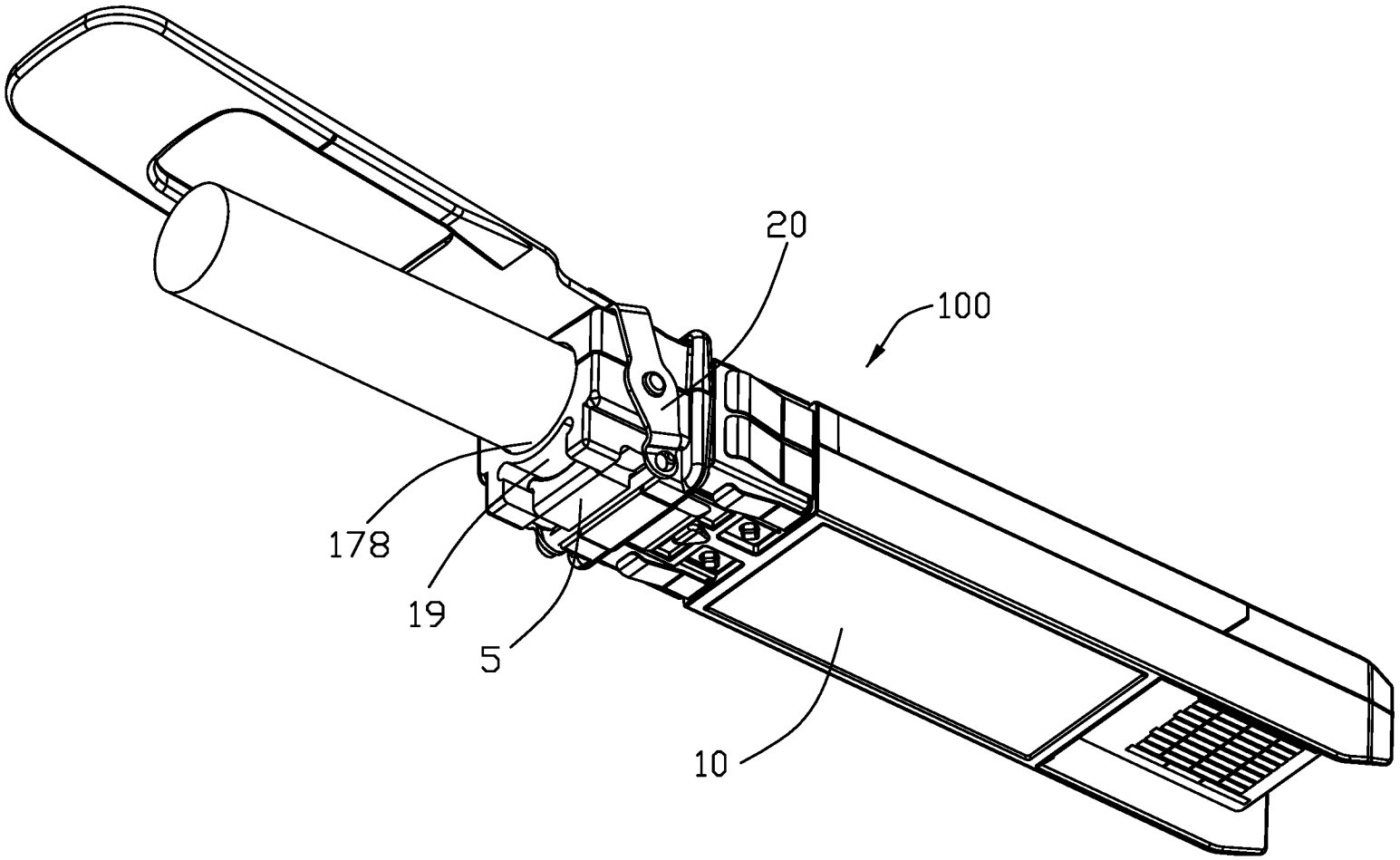
FIG. 2 is another perspective view of the connector accordance with the present invention as shown in FIG. 1.
Figure 3:
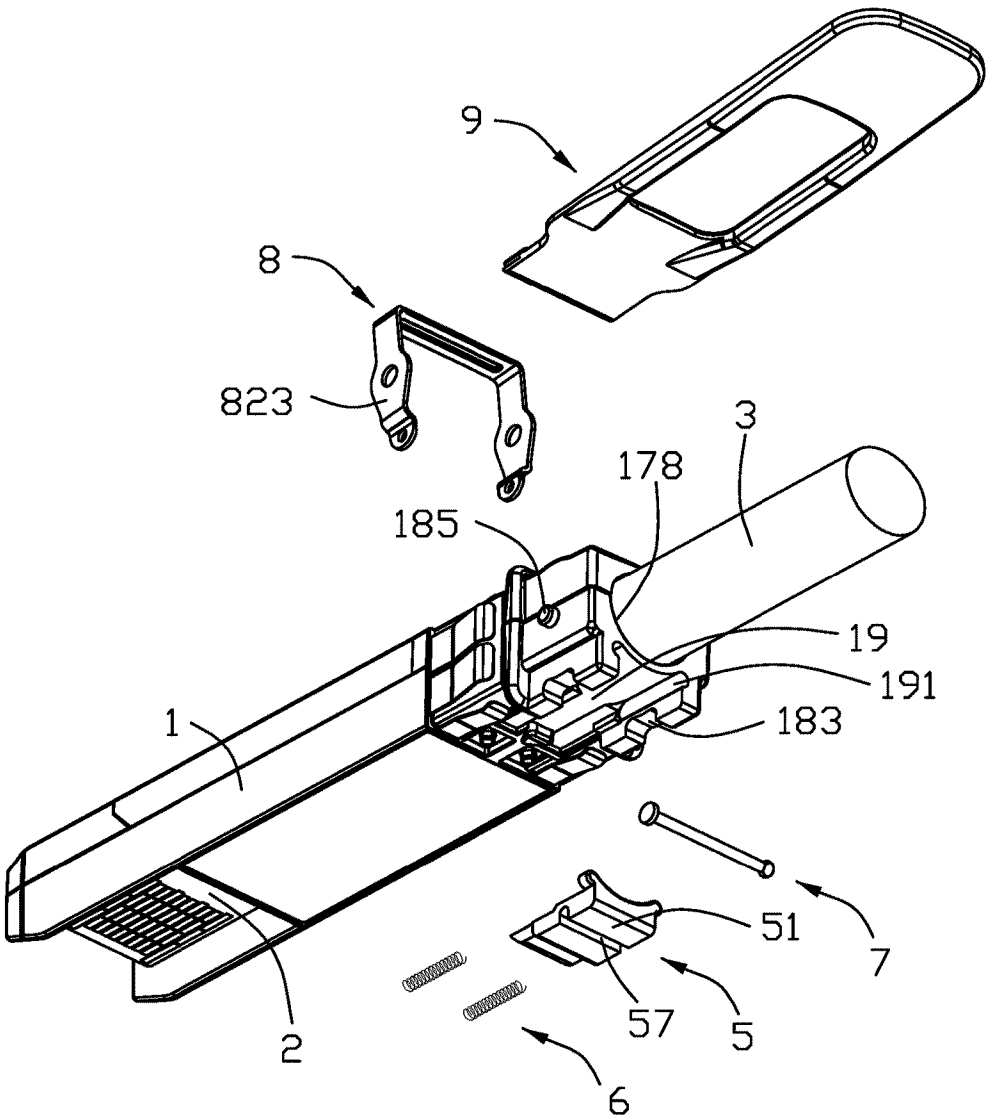
FIG. 3 is a partial exploded view of the connector as shown in FIG. 1.
Figure 4:
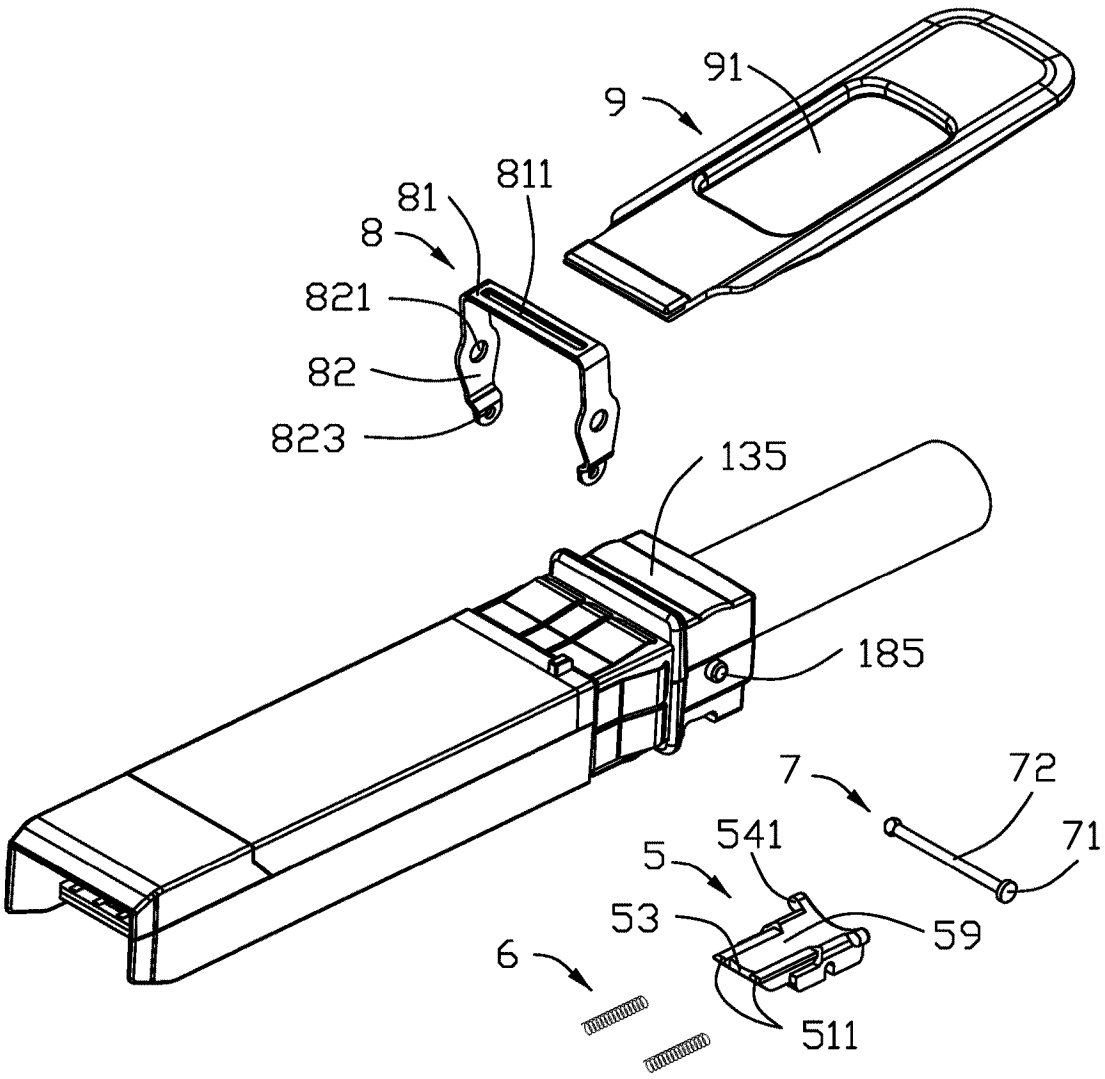
FIG. 4 is another exploded view of the connector as shown in FIG. 3.
Figure 5:
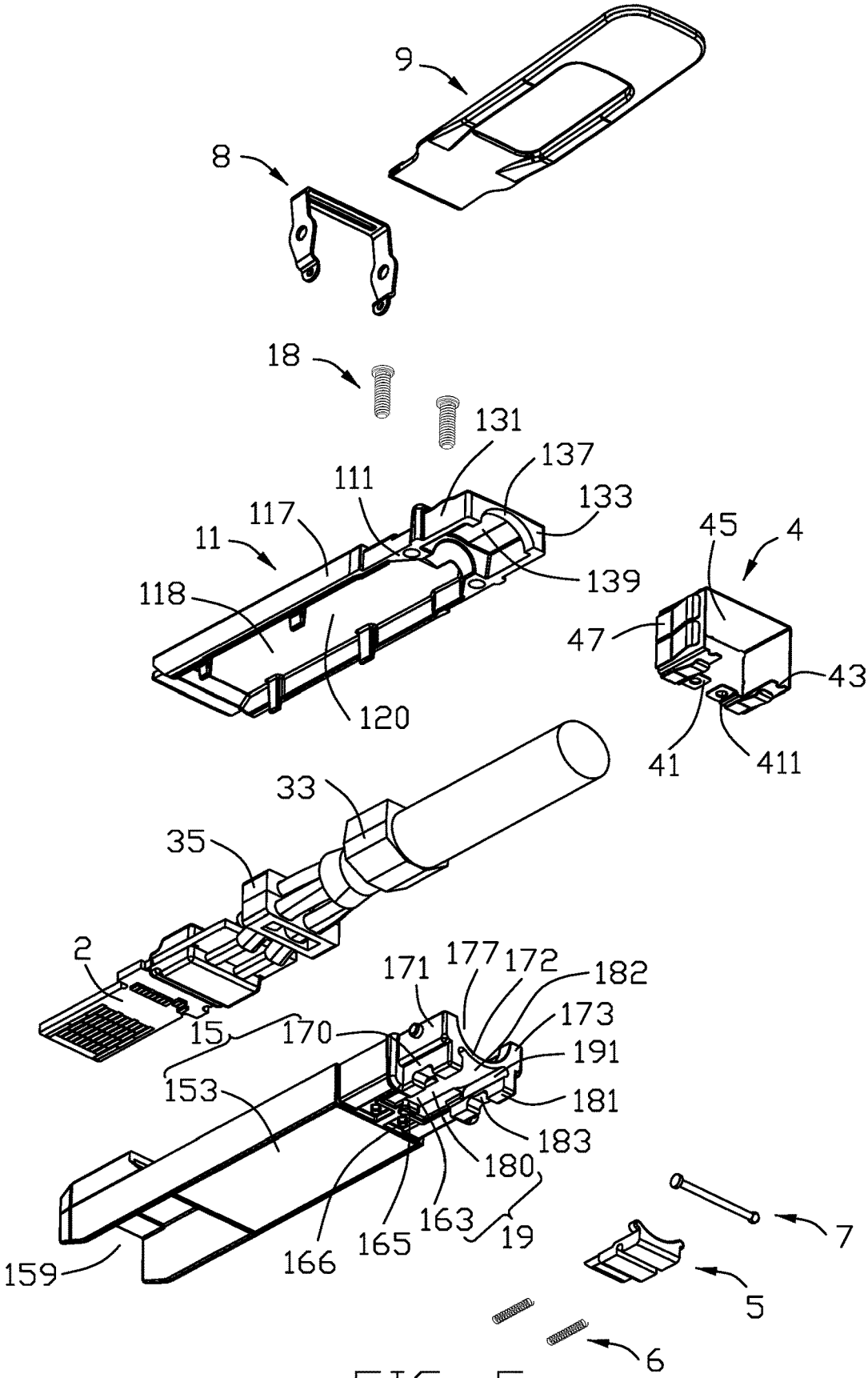
FIG. 5 is a further exploded view of the connector as shown in FIG. 3.
Figure 6:
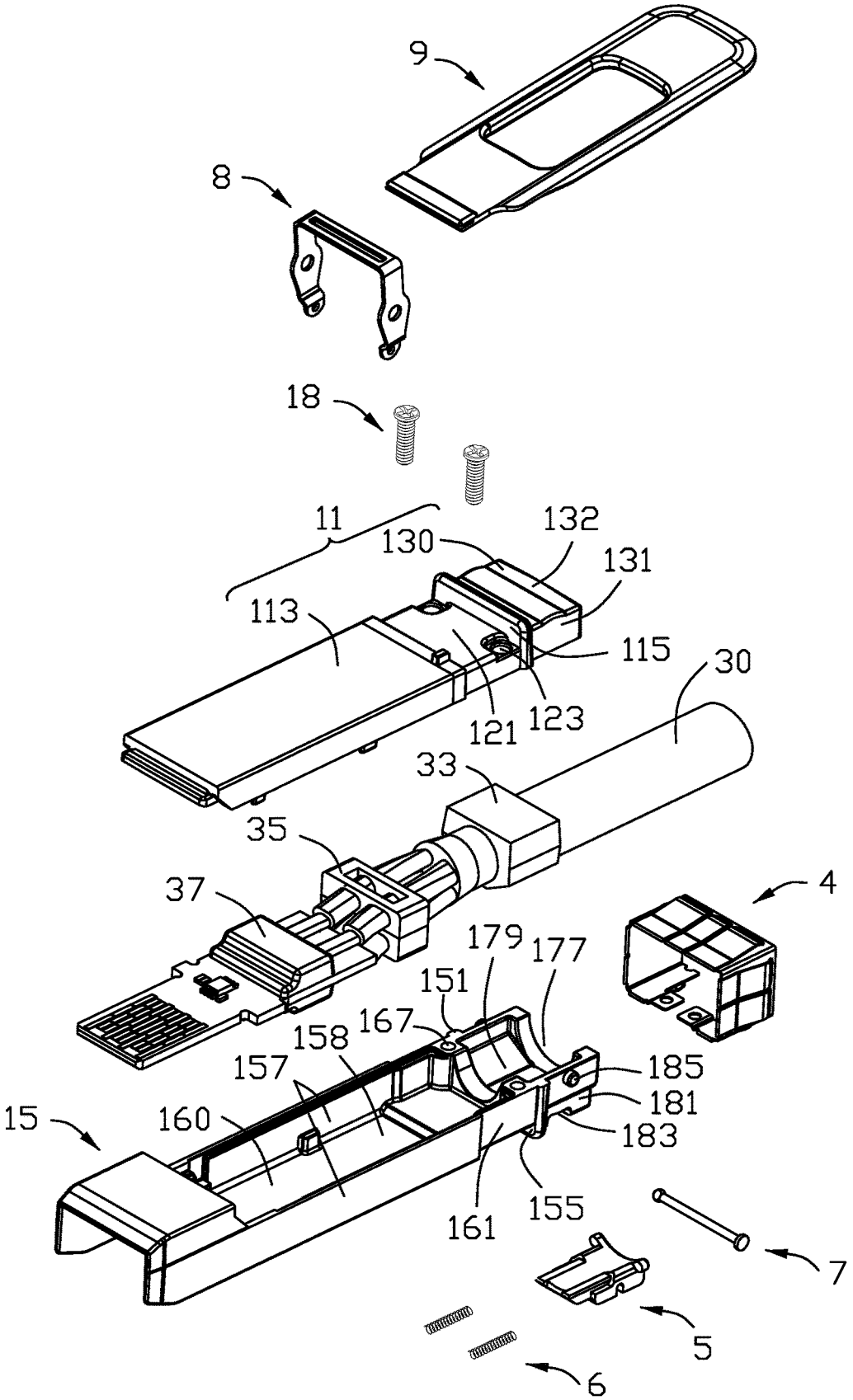
FIG. 6 is another exploded view of connector as shown in FIG. 5.
Figure 7:
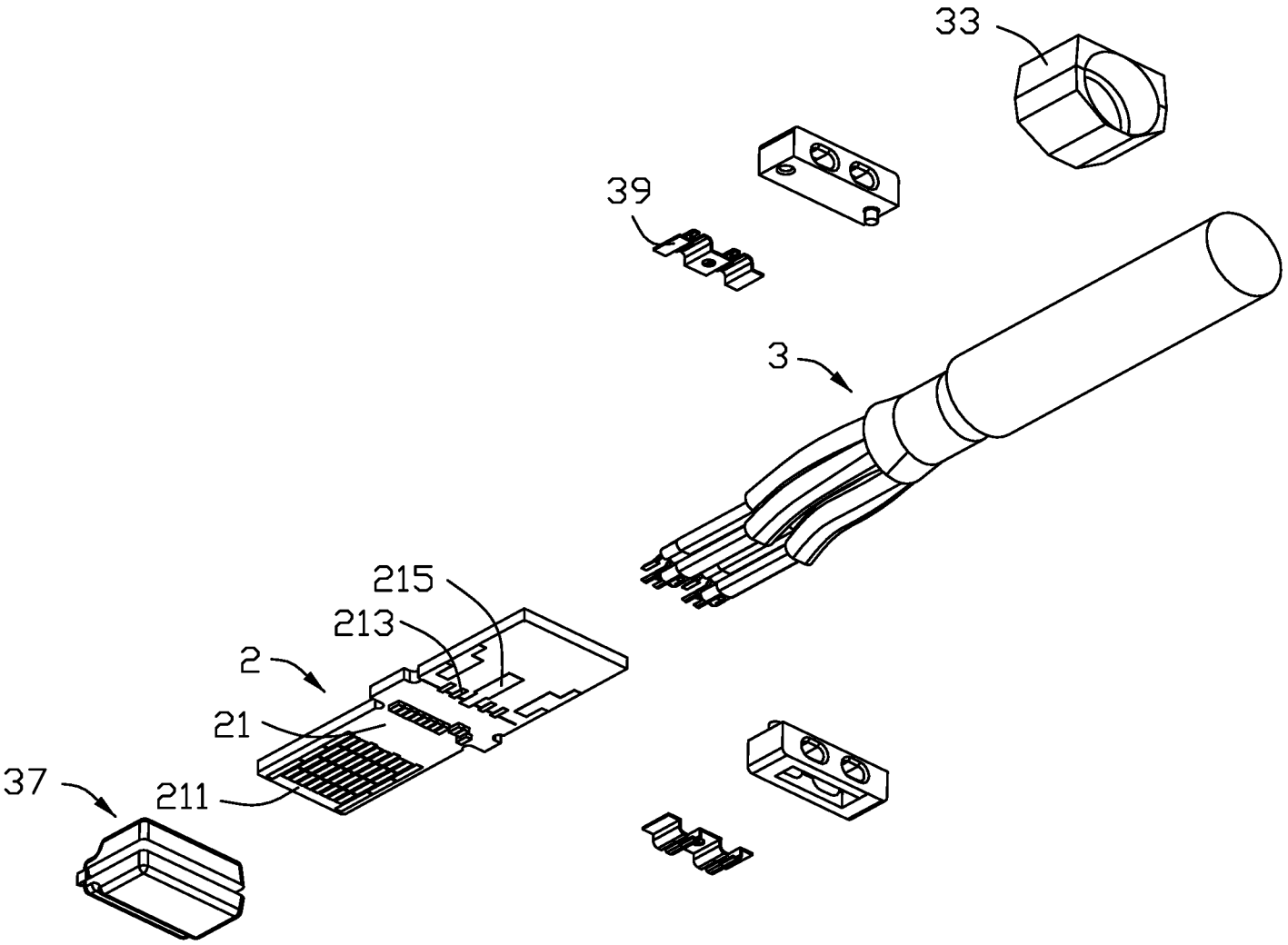
FIG. 7 is an exploded view of the connector shown in FIG. 1 with the housing and unlocking mechanism removed.
Figure 8:
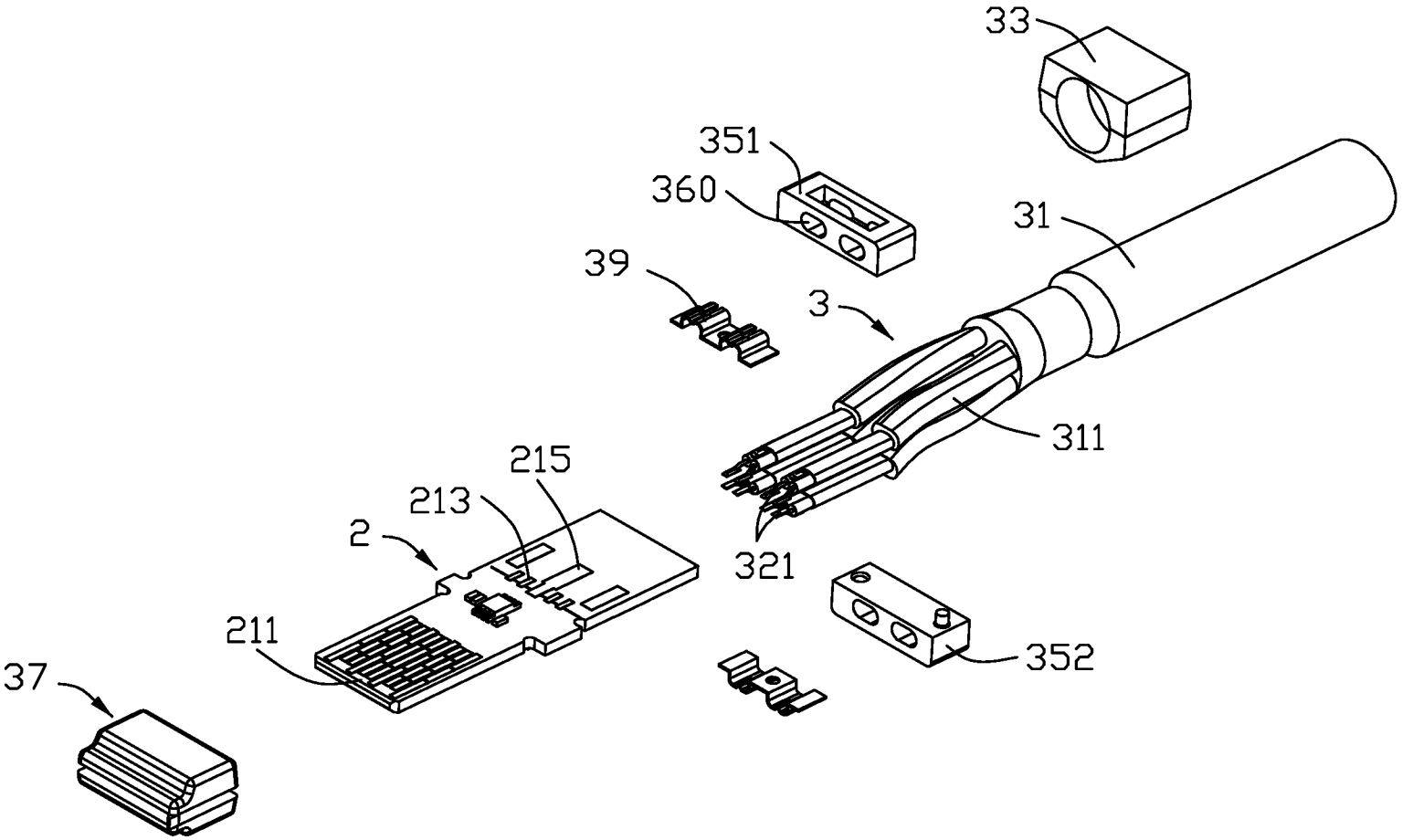
FIG. 8 is another view of the connector as shown in FIG. 7.
Figure 9:
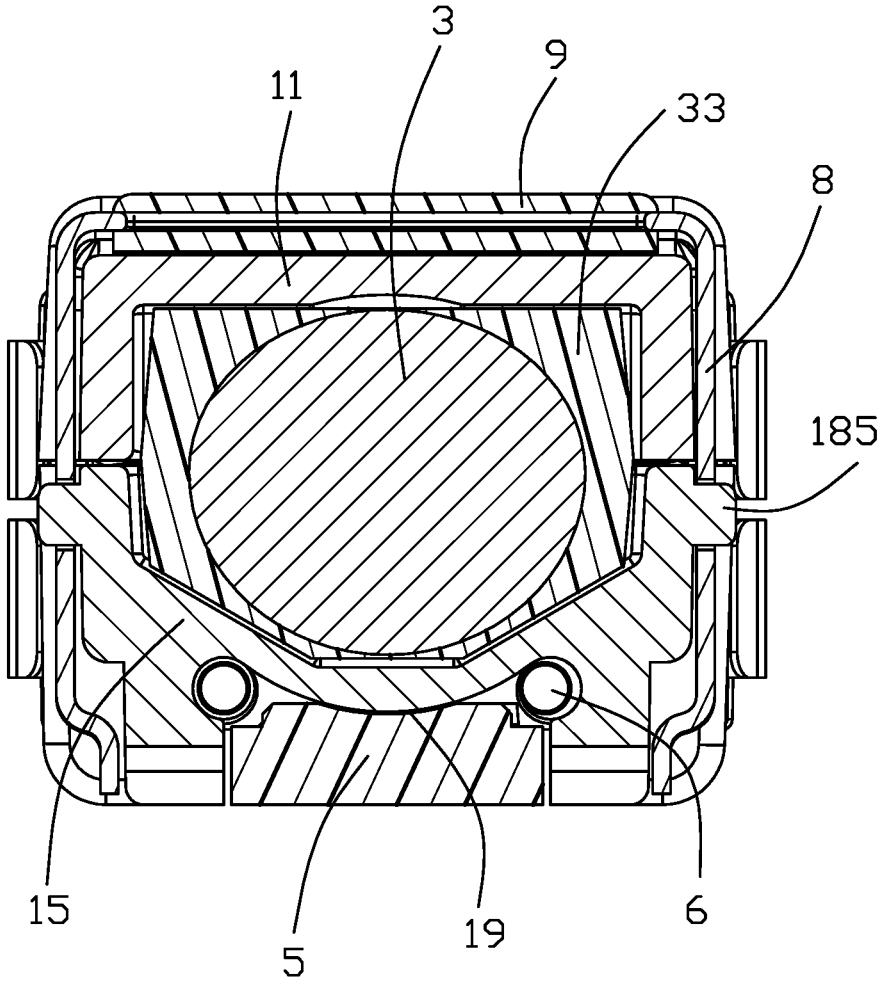
FIG. 9 is a cross-sectional view along line 9-9 of the connector as shown in FIG. 1.

Referring to FIG. 1-9, a connector 100 of the present invention is configured can be mated with the mating shell of mating connector through a lock, the connector 100 comprising a connector body 10 and a locking mechanism 20 held on the connector body 10. The connector body includes a housing 1, a printed circuit board 2 housed in the housing 1, and a cable 3 electrically connected to the printed circuit board 2.

The housing 1 includes, in a vertical direction, an upper housing 11 and a lower housing 15 cooperating with the upper housing 11. The upper housing 11 is provided with mating surfaces 111 and the lower housing 15 is provided with mating surfaces 151. When the upper housing 11 and the lower housing 15 are mated with each other, the mating surfaces 111 and 151 are coincident with each other. The upper housing 11 is formed by integral die-casting, and includes a first body portion 113 and a first mounting portion 130 extending backward from the first body portion 113 along a front-to-back direction perpendicular to the vertical direction. A first stop 115 protrudes outward is provided between the first body portion 113 and the first mounting portion 130. The first body portion 113 is provided with two opposite side walls 117 and an upper wall 118 connecting the two side walls 117. The two side walls 117 and the upper wall 118 jointly form a receiving space 120 with an opening downward. The rear portion of the side wall 117 is recessed inwardly and the rear portion of the upper wall 118 is recessed downward to form a first recessed groove 121. The first recessed groove 121 is located in front of the first stopper 115. The first recessed groove 121 is provided with a pair of through holes 123 penetrating the first recessed groove 121 in the up-down direction. The first mounting portion 130 includes a pair of side walls 131, an upper wall 132 and a rear wall 133. The outer surface of the upper wall 132 from front to back is designed to be a flat surface, a convex arc surface 135 and a flat surface. The rear wall 133 is provided with a first semi-circular opening 137 penetrating the rear wall 133 in the front-rear direction. The pair of side walls 131, the upper wall 132 and the rear wall 133 together to form a first positioning groove 139 having a receiving space. The first semi-circular opening 137 of the rear wall communicates the receiving space and the external space in the mating direction.

The lower housing 15 is also formed by integral die-casting, and includes a second body portion 153 and a second mounting portion 170 extending backward from the second body portion 153. The second body portion 153 and the first body portion 113 cooperate with each other, and the second mounting portion 170 cooperates with the first mounting portion 130. The second body portion 153 is provided with two opposite side walls 157 and a lower wall 158 connecting the two side walls 157. The two side walls 157 and the lower wall 158 form a receiving space 160 with an upward opening. A second stop 155 protrudes outward is provided between the second body portion 153 and the second mounting portion 170. The rear portion of the side wall 157 is recessed inwardly and the rear portion of the lower wall 158 is recessed upward to form a second recessed groove 161. A front end portion of the lower wall 158 is cut away to form a mating port 159 for mating with a mating connector. The rear outer surface of the lower wall 158 is provided with a first slide groove 163 located in the middle region. An arc-shaped surface formed convexly in the middle of the outer surface of the first slide groove 163. A triangular/locking boss 165 protruding outward is provided at the front of the first slide groove 163. The triangular boss 165 can form a locking fit with the shell of the mating connector. A pair of mounting posts 166 respectively disposed on the front sides of the triangular boss 165. A pair of screw holes 167 provided on the mating surface 151 of the lower housing 15.The pair of screw holes 167 of the lower housing 15 correspond to the through holes 123 of the upper housing 11, the upper housing 11 and the lower housing 15 are firmly fixed together by a pair of screws 18.

The second mounting portion 170 includes a pair of side walls 171, a lower wall 172 and a rear wall 173. The rear wall 173 is provided with a second semi-circular opening 177 penetrating the rear wall 173 in the front-rear direction. The pair of side walls 171, the lower wall 172 and the rear wall 173 together to form a second positioning groove 179 having a receiving space. The second semi-circular opening 177 of the rear wall communicates the receiving space and the external space in the mating direction. The second semi-circular opening 177 and the first semi-circular opening 137 cooperate to form a substantially circular opening 178. The circular opening 178 communicates the receiving space defined by the second positioning groove 179 and the first positioning groove 139 and the external space at the rear part thereof. The lower wall 172 is provided with a second slide groove 180. A convex surface 182 formed by the outer surface of the second slide groove 180 protrudes from a position near the two side walls 171 toward an intermediate position. The second slide grooves 180 and the first slide grooves 163 of the second body portion 153 are connected together to form a continuous slide groove 19. The slide groove 19 extends backward to the rear end surface of the second mounting portion 170. The second mounting portion 170 includes a pair of limiting portions 181 projecting downward from both sides of the lower wall 172. Each limiting portions 181 includes a guide groove 183 passing therethrough in the left-right direction. The left and right sides of the rear portion of the slide groove 19 are further recessed into the second mounting portion 170 to form a pair of receiving cavities 191. The receiving cavity 191 is recessed toward both sides along the arc shape of the arc-shaped convex surface 182. The receiving cavity 191 and the slide groove 19 are connected to the external space backward. A pair of rotating shafts 185 respectively protrudes outward from the outer surface of the side walls 171 of the second mounting portion 170 to define a pivot, along a transverse direction perpendicular to both the vertical direction and the front-to-back direction, about which the rotating member 8 is rotated.

The printed circuit board 2 includes a substrate 21, a plurality of conductive pad 211 located at the front of the substrate 21, and a plurality of soldering pad located at the rear of the substrate 21, and the soldering pad include signal soldering pad 213 and ground soldering pad 215 between the signal soldering pad 213. The upper and lower surfaces of the substrate 21 are provided with conductive pad 211 and soldering pad. The printed circuit board 2 is housed between the upper housing 11 and the lower hosing 15, and the conductive pad 211 at the front end of the printed circuit board 2 is exposed to the outside through the mating port 159 at the front end of the lower housing 15.

The cable 3 includes an insulating cover 31 and a plurality of sets of wires 311 inserted into the insulating cover 31 and extending forward from the insulating cover 31. In this embodiment, four sets of wires 311 are provided, and two sets of wires 311 are respectively provided on the upper and lower sides of the circuit board. The outer portion of the insulating cover 31 is provided with a cable holder 33 which is integrally formed outside the insulating cover 31 and the cable holder 33 is installed in a receiving space defined by the first positioning groove 139 and the second positioning groove 179, and is used to define the position of the cable 3 in the housing 1. The wire 311 is provided with a wire management block 35 outside, and the wire management block 35 is composed of an upper wire management block 351 and a lower wire management block 353 which are matched with each other. Each of the upper wire management block 351 and the lower wire management block 353 is provided with two holes 360 through which the wires 311 can pass in the front-rear direction. The grounding soldering pad 215 of the printed circuit board 2 is further soldered with a grounding pad 39. Before the cable 3 is soldered to the signal soldering pad 213, it first passes through the holes 360 in the wire management block 35, and then soldered to the signal soldering pad 213 on the printed circuit board 2, and then the grounding pad 39 is soldered to the grounding welding pad 215 Finally, a protective block 37 is formed outside the soldering point of the cable 3 and the soldering point of the grounding plate by a molding process.

The connector 100 further includes a ferrule 4 sleeved on the outside of the housing 1 thereof. The ferrule 4 is installed in the first recessed groove 121 of the upper housing 11 and the second recessed groove 161 of the lower housing 15. The ferrule 4 is made of metal sheet. It is composed of four sides. It consists of four sides, one of which has an opening so that it can be assembled outside the connector housing 1. A pair of fixing pieces 41 protruded oppositely on the side provided with the opening. The pair of fixing pieces 41 are respectively provided with mounting holes 411, and the mounting holes 411 respectively cooperate with the mounting posts 166 on the housing. Semi-circular openings 43 are respectively provided on the rear sides of the open side for cooperating with the protrusions (not shown) on the lower housing. The ferrule 4 includes a frame portion 45 that is attached to the housing 1 and a plurality of elastic pieces 47 that are bent and extended backward from the front end of the frame portion 45. The elastic pieces 47 are arranged at intervals and gradually spread outward from the front end of the frame body portion 45 backward.

The unlocking mechanism 20 comprising an unlocking slider 5 that can slide between the locking position and the unlocking position of the connector body 10, an elastic member 6 that can drive the sliding of the unlocking slider 5, and an actuating member 7 that drives the sliding of the unlocking slider 5, a rotating member 8 connected to the actuating member 7 and a pulling belt 9 pulling the rotating member 8 to rotate. The unlocking slider 5 comprising a body portion 51 and a pair of wedge-shaped arm portions 511 extending forward from the body portion 51. The pair of wedge-shaped arm portions 511 are being spaced apart from each other to form an opening 53. The opening 53 corresponds to the triangular boss 165 on the lower housing 15. The unlocking slider 5 is installed in the slide groove 19 of the lower housing and can slide in the slide groove. The surface where the unlocking slider 5 and the slide groove 19 cooperate with each other is the mating surface, and the surface opposite to the mating surface is the outer surface. The outer surface is provided with a lateral groove 57 extending through it in lateral direction. The matching surfaces are recessed from the left and right sides to the middle direction to form an arc-shaped concave surface 59 that cooperates with the arc-shaped convex surface on the slide groove 19. The arc-shaped concave surface 59 makes the left and right sides of the unlocking slider 5 thicker. A pair of fixed posts or abutting ears 541 respectively arranged on the left and right sides of the rear part of the unlocking slider 5. The fixed post 541 and the receiving cavity 191 of the lower housing 15 cooperate with each other.The elastic member 6 includes a pair of coil/compressive springs arranged at intervals. The elastic member 6 can also be other elastic materials. In this embodiment, the elastic member 6 is a spring.The pair of springs are respectively provided in the left and right regions of the thicker wall of the unlocking slider 5.The pair of springs are respectively inserted into the receiving cavity 191 of the lower housing 15. The spring is located in front of the fixed post 541, and the front end surface of the fixed post 541 abuts the rear end of the spring. The actuating member 7 is rod-shaped, and includes a head 71 and a rod portion 72 connected to the head 71. The rod portion 72 is located in the lateral groove 57 of the unlocking slider 5. The rotating member 8 has a door frame shape and includes a transverse frame 81 and two side frames 82 connected to the transverse frame. The transverse frame is provided with an elongated opening 811. A positioning hole 821 is provided in the middle of each side frame 82, and a mounting hole 823 is provided at the bottom end of the side frame 82. A pair of the positioning holes 821 is installed on the rotating shaft 185 of the lower housing 15. A pair of the mounting holes 823 is mounted on the rod portion 72 of the actuating member 7. The pulling belt 9 is provided with an annular opening 91 that can be pulled by fingers.The pull belt 9 is formed on the transverse frame 81 of the rotating member 8. The rod portion 72 of the actuating member 7 passes through the guide groove 183 of the lower housing 15, the mounting hole 823 of the rotating member 8 and the lateral groove 57 of the unlocking slider 5. The rod portion 72 of the actuating member 7 is riveted at the end opposite to the head to attach the actuating member 7 to the connector 100.

When assembling the unlocking mechanism 20, first install two springs into the receiving cavity 191 on both sides of the slide groove 19, and then slide the unlocking slider 5 into the slide groove 19 from back to front, and the two spring fixed posts 541 are received in the receiving cavity 191. The opening 53 between the arm portions 511 faces the triangular boss 165 at the front of the slide groove 19. Then, the rotating member 8 is assembled on the second mounting portion 170 of the lower housing 15. A pair of positioning holes 821 of the side frame 82 of the rotating member 8 are respectively mounted on the rotating shaft 185 of the second mounting portion 170. The mounting hole 823 at the end of the side frame 82 is aligned with the lateral groove 57 of the unlocking slider 5 and the guide groove 183 on the limiting portion 181. The actuating member 7 needs to be installed in the mounting hole 823, the lateral groove 57 and the guide groove 183, and the actuating member 7 is finally riveted and pressed on the rotating member 8. The actuating member 7 needs to be installed in the mounting hole 823, the lateral groove 57 and the guide groove 183, and the actuator 7 is finally riveted and pressed on the rotating member 8.

When assembling the connector 100. firstly the cable 3 is soldered to the signal soldering pad 213 of the printed circuit board 2, the printed circuit board 2 and the front of the cable 3 are assembled into the housing 1, and the rear of the cable 3 extends from the circular opening 178 out of the housing 1. Then the upper housing 11 and the lower housing 15 are fixed to each other, and the ferrule 4 is installed in the first recessed groove 121 of the upper housing 11 and the second recessed groove 161 of the lower housing 15. Finally the unlocking mechanism 20 is installed on the housing 1 of the connector 100.

When the connector 100 is mating with the mating shell of the mating connector, the triangular boss 165 on the housing 1 cooperates with the opening latch on the mating connector housing, and the unlocking mechanism 20 is in a natural state.

When the connector 100 is to be separated from the mating shell of the mating connector, the pulling belt 9 is pulled, which exerts a backward pulling force on the transverse frame 81 of the rotating member 8, the rotating member 8 rotates around the rotating shaft 185, and then the unlocking slider 5 is driven to slide forward by the actuating member 7 mounted on the rotating member 8. At this time, the elastic member 6 is compressed, and the triangular boss is located in the opening 53 between the two arm portions 511 on the unlocking slider 5, and the two arm portions 511 are pushed against the mating shell of the mating connector, the connector 100 can be pulled out from the mating connector. After the unlocking is completed, the spring returns, providing an elastic restoring force to push the unlocking slider 5 to slide backward, and then the unlocking mechanism 20 is in a natural state.

In the present invention, the unlocking slider 5 of the unlocking mechanism 20 and the housing 1 on which the unlocking slider 5 is installed are designed to accommodate the radial dimension of the wire contained in the housing 1, so as to ensure the wall thickness of the housing 1 to achieve strength at the same time can accommodate larger diameter cables.

The above are only some of the embodiments of the present invention, but not all of the embodiments. Any equivalent changes to the technical solutions of the present invention by those skilled in the art by reading the description of the present invention are covered by the claims of the present invention.

What is claimed is:

1. A connector to be mated with a mating connector through a lock, comprising:

a connector body including:

a mounting portion having a receiving space; and a slide groove provided on the mounting portion; and an unlocking mechanism held on the connector body, the unlocking mechanism including:

an unlocking slider slidable along the slide groove; and an elastic member for driving the unlocking slider to slide; wherein the slide groove has a convex surface protruding outward, the unlocking slider has a concave surface cooperating with the convex surface of the slide groove, the concave surface makes a wall thickness of the unlocking slider uneven, and the elastic member is located at an area of the unlocking slider having a thicker wall thickness.

2. The connector as claimed in claim 1, further including a circuit board and a cable that is electrically connected to the circuit board through the receiving space.

3. The connector as claimed in claim 1, wherein a cross-sectional shape of the receiving space is circular.

4. The connector as claimed in claim 1, wherein the concave surface is an arc-shaped concave surface, and the elastic member includes a pair of springs respectively disposed on two sides of the arc-shaped concave surface of the unlocking slider.

5. The connector as claimed in claim 4, wherein the convex surface of the slide groove is designed as an arc-shaped convex surface, and two sides of the arc-shaped convex surface are recessed toward the connector body to form a pair of receiving cavities, and the two springs are respectively inserted into corresponding receiving cavities.

6. The connector as claimed in claim 5, wherein a pair of fixed posts are respectively provided on the left and right sides of the rear part of the unlocking slider, and the fixed post abut one end of the spring.

7. The connector as claimed in claim 1, wherein the unlocking slider includes a body portion and a pair of arm portions extending forward from the body portion, the arm portions are spaced apart from each other to form an opening.

8. The connector as claimed in claim 1, wherein the outer surface of the unlocking slider is provided with a lateral groove extending through the lateral direction thereof, and the unlocking mechanism includes an actuating member located in the lateral groove.

9. The connector as claimed in claim 8, wherein the connector body is provided with a pair of rotating shafts protruding outward, and the unlocking mechanism includes a rotating member rotatably mounted on the rotating shaft.

10. The connector as claimed in claim 9, wherein the actuating member is connected to the rotating member and the actuating member is able to drive the unlocking slider to slide in the slide groove through the rotation of the rotating member.

11. An electrical connector to be mated with a mating connector, comprising:

a connector body including:

a mounting portion having a receiving space receiving a round cable therein;

a locking boss formed on an undersurface of the mounting portion;

a slide groove formed in the undersurface of the mounting portion behind the locking boss in a front-to-back direction;

an unlocking mechanism pivotally mounted upon the mounting portion with a pivot extending in a transverse direction perpendicular to the front-to-back direction, the unlocking mechanism including:

an unlocking slider slidable along the slide groove in the front-to-back direction with a pair of outwardly protruding abutting ears formed at a rear end of the unlocking slider and opposite to each other in the transverse direction; and a pair of compressive coil springs associated with the unlocking slider to constantly urge the unlocking slider rearwardly; wherein the slide groove forms a pair of receiving cavities at two opposite sides in the transverse direction to receive the pair of compressive coil springs and the pair of abutting ears; wherein the pair of compressive coil springs are aligned with the pair of abutting ears in the front-to-back direction, and a rear end of each compressive coil spring rearwardly abuts against the corresponding abutting ear in the front-to-back direction.

12. The electrical connector as claimed in claim 11, wherein the undersurface of the mounting portion forms a convex configuration in compliance with a contour of the round cable and in confrontation with the slide groove in a vertical direction perpendicular to both the front-to-back direction and the transverse direction, and said pair of receiving cavities are located at two sides of said convex configuration in the transverse direction.

13. The electrical connector as claimed in claim 12, wherein the unlocking slider forms a concave configuration to comply with the convex configuration in the vertical direction.

14. The electrical connector as claimed in claim 11, wherein said pair of abutting ears are located at opposite upper corners of the unlocking slider, viewed along the front-to-back direction.

15. The electrical connector as claimed in claim 11, wherein a front end of each compressive coil spring forwardly abuts against a corresponding portion of the mounting portion in the front-to-back direction.

* * * * *